US009622555B2

(12) United States Patent
Kopel et al.

(10) Patent No.: US 9,622,555 B2
(45) Date of Patent: Apr. 18, 2017

(54) SYSTEM FOR AVOIDING CREDIT CARD LOSS

(71) Applicants: David Kopel, Agoura Hills, CA (US); Mark Ronald Schwab, Lincoln, NE (US)

(72) Inventors: David Kopel, Agoura Hills, CA (US); Mark Ronald Schwab, Lincoln, NE (US)

(73) Assignee: David Kopel, Agoura Hills, CA (US)

( * ) Notice: Subject to any disclaimer, the term of this patent is extended or adjusted under 35 U.S.C. 154(b) by 0 days.

(21) Appl. No.: 14/792,209

(22) Filed: Jul. 6, 2015

(65) Prior Publication Data

US 2016/0000196 A1 Jan. 7, 2016

Related U.S. Application Data

(60) Provisional application No. 62/021,594, filed on Jul. 7, 2014.

(51) Int. Cl.
*A45C 1/06* (2006.01)
*A45C 11/18* (2006.01)

(52) U.S. Cl.
CPC ..... *A45C 1/06* (2013.01); *A45C 11/184* (2013.01); *A45C 2001/065* (2013.01)

(58) Field of Classification Search
None
See application file for complete search history.

(56) References Cited

U.S. PATENT DOCUMENTS

| | | | | |
|---|---|---|---|---|
| 6,184,788 | B1 * | 2/2001 | Middlemiss | A45C 11/184 340/522 |
| 6,400,270 | B1 * | 6/2002 | Person | A45C 11/184 340/531 |
| 2005/0184150 | A1 * | 8/2005 | Welte | G06K 17/00 235/385 |
| 2006/0232398 | A1 * | 10/2006 | Nedblake | G08B 13/1427 340/539.13 |
| 2015/0156297 | A1 * | 6/2015 | Crawford | H04B 5/0037 455/26.1 |

* cited by examiner

*Primary Examiner* — Leon-Viet Nguyen
(74) *Attorney, Agent, or Firm* — Arthur Freilich

(57) ABSTRACT

A system for detecting when a credit card is withdrawn, or otherwise becomes missing, from a user's wallet and for alerting the user when he has moved a certain distance away from his original location without replacing the card.

22 Claims, 5 Drawing Sheets

SYSTEM FOR AVOIDING CREDIT CARD LOSS

RELATED APPLICATION

This application claims the benefit of U.S. provisional application 62/021,594 filed Jul. 7, 2014 which is incorporated herein by reference.

FIELD OF THE INVENTION

This invention relates to a system for recognizing when a credit card becomes missing from a user's wallet and for alerting the user of the missing card.

BACKGROUND OF THE INVENTION

Many prior art systems function to recognize when a credit card is withdrawn from a wallet for the purpose of alerting a user. For example, when a user withdraws a credit card from his wallet in a restaurant, an audible alert can be periodically sounded until the missing card is returned. Although such systems can be helpful in reducing the likelihood of a user inadvertently leaving his credit card at the restaurant, they are of little help to a user who only later discovers the card is missing and is unable to recall where he left it. Moreover, periodically alerting the user while waiting for the waiter to return the card can be bothersome.

SUMMARY OF THE INVENTION

The present invention is directed to a system for detecting when a credit card is withdrawn, or otherwise becomes missing, from a user's wallet and for alerting the user when he has moved a certain distance away from his original location without replacing the card. Preferably, a system in accordance with the invention also stores data identifying the physical location and time of day when the card is initially detected as missing. It should be understood that the term "wallet" as used herein is intended to cover a wide variety of card holders including, for example, a card section of a purse or handbag. Also, the term "credit card" as used herein generally contemplates a card carrying identification data which can be read by known contactless smart card readers but the term is also intended to more broadly include a variety of other cards useful for various purposes, such as driver's license cards, membership cards, etc.

A system in accordance with the invention is intended for use with a wallet configured to accommodate multiple credit cards and includes a card reader mounted in the wallet for determining whether each card of an initial card set is present or absent from the wallet. A preferred card reader in accordance with the invention is operable to recognize when a credit card is withdrawn, i.e., absent, from the wallet and to then alert the user when he and the wallet have moved away a certain distance from his original location without replacing the card. The displacement of the user (and his wallet) from the original location can be monitored by a pedometer which can be implemented in a variety of ways. For example, the wallet preferably includes an accelerometer/gyro capable of measuring the distance (displacement) the user has moved away from his original location. Alternatively, and/or additionally, the card reader is capable of determining the wallet's current physical location (using available location determining technology such as GPS, WiFi, cell tower, etc.) enabling location data describing the original, or reference, location to be stored and then compared with a subsequently determined location to calculate the displacement. The original location data, along with time of day information, is preferably stored as reference information in a user accessible storage. In the event the user fails to discover that a credit card is missing for some extended period, he can then access the stored information to help him retrieve the missing card.

A card reader useful in embodiments of the invention can take various forms. For example, a basic card reader can be comprised of a plurality of switches, each assigned to monitor a different wallet pocket to determine whether it is vacant or occupied. Preferably, however, the card reader comprises a contactless smart card reader capable of interrogating an initial set of smart cards to produce a table describing all of the cards in the initial set. The card reader then subsequently interrogates the cards to determine the presence/absence of each card in the set. The term "smart" card as used herein is intended to include various cards capable of being read by a contactless smart card reader, typically employing RF communication.

A significant feature of a preferred embodiment of the invention enables the card reader to be paired with and wirelessly communicate (e.g., via Bluetooth) with a user's mobile device (e.g., smart phone, tablet, wearable, etc.). This capability allows, for example, for execution of apps on the mobile device enabling a user to interact with the card reader to set/control various parameters, e.g., volume and frequency of alerts, communication with remote processors, scheduling, threshold values, etc. The mobile device (presumably carried by the user) functions to monitor the user's movement and/or current location for comparison with stored reference information, for as long as the reader continues to report the card absent. In practice, this capability reduces the likelihood of a user forgetting his credit card, for example at a restaurant. If the restaurant user departs from his table without his card, the mobile device will observe an increasing displacement between its current location and the original reference location. When the displacement reaches a threshold value, the mobile device will alert the user enabling him to retrieve his card before leaving the restaurant. However, even if the user fails to respond to the alert before leaving the restaurant, the mobile device can continue to periodically alert him as long as the card remains missing. When he finally discovers the card is missing, he can access any stored reference information to assist him in retrieving the card.

It is recognized that systems in accordance with the invention can employ card readers implemented in various ways. For example, a basic card reader can comprise contact switches, e.g., as illustrated in U.S. Pat. No. 4,890,094, or alternatively can comprise various forms of proximity sensors known in the art. In a preferred embodiment, however, it is assumed that each card carries unique identification data (e.g., RFID tag) which can be read by a contactless smart card reader mounted in the wallet. Each RFID tag can comprise a chip integral to most available smart cards or can comprise a printed RFID label configured to be adhered by the user to a traditional credit card. Regardless, the contactless reader is able to establish an inventory of cards in an initial card set and subsequently recognize when a card is missing.

Although smart cards and RFID tags are typically passive (i.e., no battery), most suitable card readers require battery power. In accordance with a useful feature of a preferred embodiment, the operational duty cycle (i.e., on-time) of the reader is minimized to extend useful battery life. More particularly, the reader's power supply is preferably selectively enabled in response to some triggering event, such as the opening, i.e., unfolding, of the wallet, which typically occurs just prior to withdrawing a card. When the wallet is closed, the power supply can default to a power saving state.

The aforementioned mobile device is able to monitor the displacement between the original reference location stored when a card is initially recognized as absent and the current location of the user and his mobile device. If the displacement exceeds a threshold value, an alarm is generated to alert the user. Additionally, the mobile processor (and/or the card reader) can alert the security function of a relevant credit card company to advise of the missing card and its reference location to help prevent the card from being misused at some distant location. This feature can also be advantageously employed in other situations to reduce security breaches, e.g., at airport security.

In some embodiments of the invention, the card reader mounted in the wallet includes adequate power and processing capability to perform the desired functions, e.g., determine card missing status, location, and displacement magnitude, but it is recognized that in other embodiments, some or all of this functionality can better be performed by the user's paired mobile device, e.g. smart phone.

DETAILED DESCRIPTION

Figure 1:
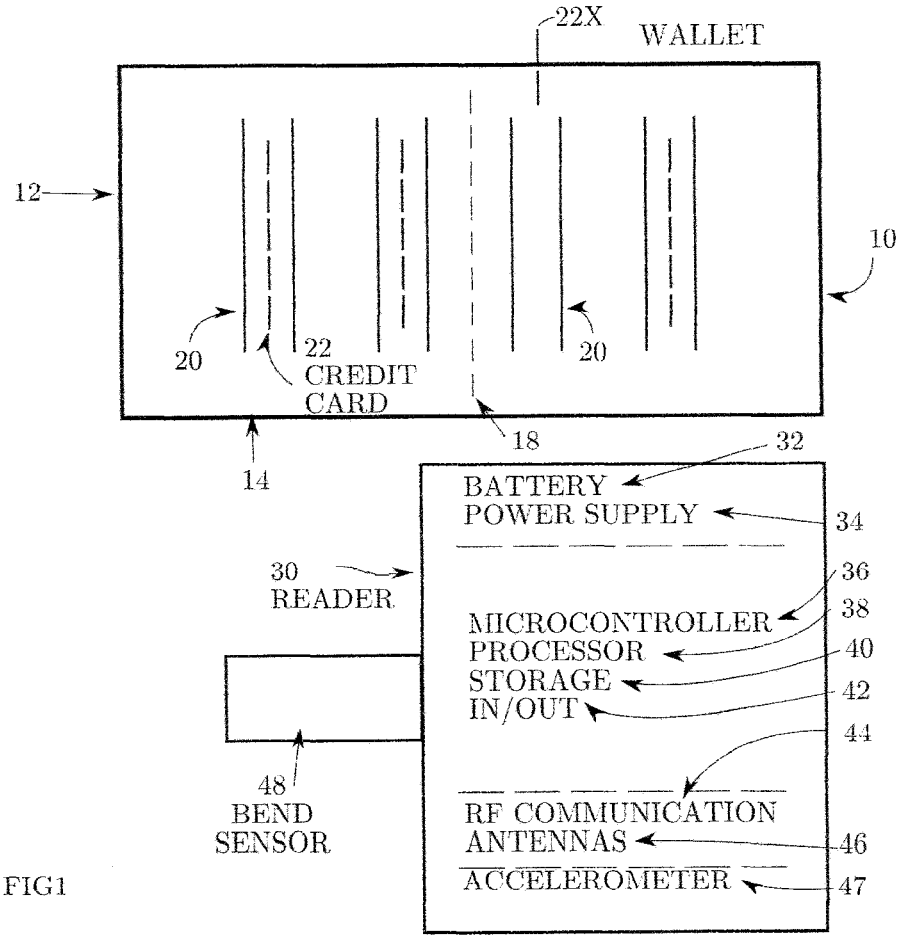
FIG. 1 is a functional block diagram of a basic system embodiment of the present invention.

FIG. 1 illustrates a functional block diagram of a system 10 in accordance with one embodiment of the present invention. The system 10 is intended for use with an exemplary wallet 12 comprising side panels 14, 16 arranged to open/close around a fold line 18. Panels 14, 16 typically have multiple card pockets 20, each for accommodating a credit card 22. The system in accordance with the invention is designed to monitor a set of credit cards in the wallet to detect when a credit card is missing, e.g., card 22X, as compared to an initial card set.

The system 10 includes a card reader 30 which functions to recognize when a card 22 is absent, i.e., having been withdrawn, either intentionally or unintentionally, from the wallet. Cards 22 are, of course, frequently withdrawn by the user in the ordinary use of the wallet, as for example, to pay the bill in a restaurant. The system 10 preferably functions to alert the user when a card is withdrawn to discourage his inadvertently leaving the restaurant without the card but additionally, in the event he does leave the restaurant without the card, to later assist him to remember where the card was last withdrawn.

The reader 30 can be implemented in a variety of ways. A basic reader implementation is comprised of a plurality of card detectors, e.g., contact switches, where each detector is assigned to a different wallet pocket and configured to open when a card is present in the pocket and close when the pocket is empty. Alternatively, the reader 30 can comprise a contactless smart card reader capable of rapidly reading the multiple cards 22, hereinafter presumed to be smart cards, within a field essentially limited to the wallet boundaries. The technology for such card readers supporting protocol ISO14443A is known and used in various commercially available devices.

An exemplary smart card reader 30 depicted in FIG. 1 is comprised of a circuit board 32, preferably dimensioned for removable mounting in one of the wallet side panels 14, 16. The circuit board 32 carries various functional units including a battery/power supply 34, a microcontroller 36 having a processor 38, storage 40, and input/output means 42 which preferably includes an audible alert mechanism. The board 32 preferably also carries an RF communications transceiver 44 and antennas 46 (e.g., NFC antenna) for reading information from the smart cards 22 and (e.g., Bluetooth antenna) for optionally communicating with a remote mobile device and/or server, as will be further described hereinafter. Additionally, the board 32 preferably carries an accelerometer/gyro 47 for measuring the user's displacement as he moves away from a location where a missing card was initially detected.

FIG. 1 also illustrates a flexible bend sensor 48 extending outwardly from the circuit board 32 and oriented so as to bridge the wallet fold line 18 when the reader board 32 is mounted in a wallet side panel 14, 16. The bend sensor 48 functions to indicate whether the wallet is open or closed. This information can be advantageously used by the microcontroller to trigger an audible alert and to reduce battery usage when the wallet is closed.

The function of the card reader 30, regardless of its implementation, is to recognize when a card 22 is missing from the wallet 12. When this absent condition is recognized, a location routine and/or displacement determination routine is initiated. The location routine is executed by microcontroller 36 to determine the current physical location of the wallet, by e.g., street address, coordinates, establishment name, etc. This location information is then preferably stored in storage unit 40 for comparison with a later determined current physical location. The displacement determination routine is responsive to the accelerometer/gyro 48 to determine how far the wallet has moved away from an original location.

Table 1 below summarizes the possible user actions and consequent electronic subsystem actions for the system of FIG. 1. Line (1) shows that when a user withdraws a card 22, the reader 30 reports an absent card state and produces an audible alert to inform the user that a card is missing. Additionally, the location routine and/or displacement determination is executed. The location routine operates to determine the wallet's current physical location when a card is recognized as absent. This original location is then stored as a "reference" location in storage unit 40 and can be used subsequently to calculate displacement. The displacement determination routine relies on the accelerometer 48 to determine displacement.

When the absent card is replaced (Line (2)), the reader reports "occupied" and the audible alert is terminated. Although not shown in Table 1, it should be understood that prior to the card being replaced in Line (2), the user is able to access stored reference location information from storage unit 40 via input/output means 42 to assist him in determining where the card went absent.

TABLE I

| | USER ACTION | ELECTRONIC SUBSYSTEM ACTION |
|---|---|---|
| (1) | WITHDRAW CARD | READER REPORTS ABSENT CARD<br>AUDIBLE ALERT<br>LOCATION ROUTINE, STORE CURRENT LOCATION,<br>CALCULATE DISPLACEMENT<br>DISPLACEMENT DETERMINATION AS MEASURED BY ACCELEROMETER |
| (2) | REPLACE CARD | READER REPORTS "OCCUPIED"<br>TERMINATE AUDIBLE ALERT<br>READER OFF |

Figure 2:
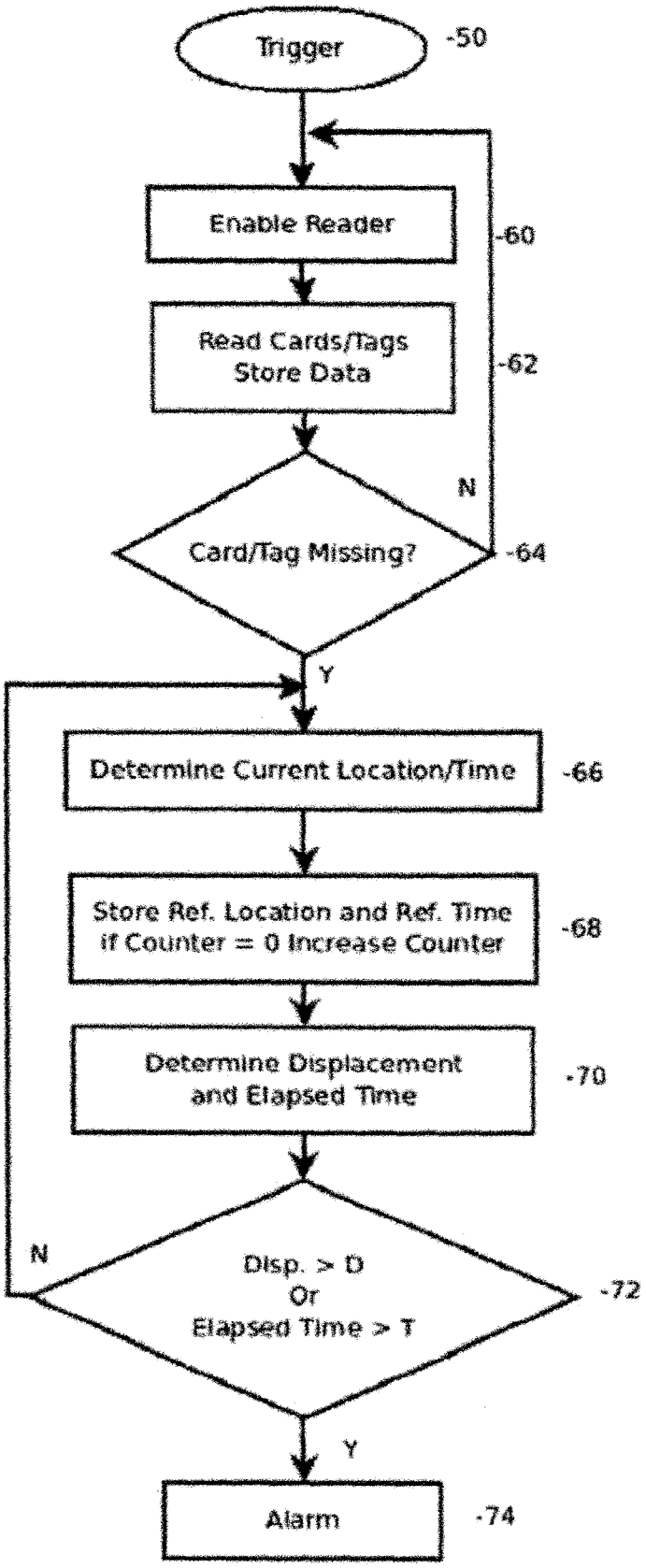
FIG. 2 is a high level flow chart depicting the operation of the embodiment of FIG. 2.

FIG. 2 is a top level flow chart depicting the overall operation of the embodiment of FIG. 1. In response to a trigger input 50, typically produced by the user opening the wallet, the card reader 30 is enabled in block 60. Consequently, in block 62, the reader 30 reads card/tag identification data which is then stored by microcontroller 36 in storage 40. Then, in block 64, the microcontroller compares the new identification data with previously stored data describing an initial card set to determine whether or not a card is missing. If NO, then operation returns to block 60. If YES, operation proceeds to block 66 for execution of a routine to determine the current location and time of day. If this is an initial cycle (counter=0) for this card missing operation, the microcontroller stores the initial location as the "reference" location (block 68) and the counter is incremented. In succeeding cycles, the microcontroller in block 70 determines the elapsed time and/or the displacement, that is, how far the wallet has moved from its original location when the card was recognized as absent to its current location utilizing the aforementioned location routine and/or the displacement determination routine. Block 72 asks whether the displacement exceeds a threshold distance D and/or the elapsed time exceeds a threshold T. If NO, operation returns to block 64 to execute another card missing cycle. If YES, alarm block 74 is executed to alert the user and perhaps third parties, e.g., a security function server of a credit card company.

Figure 3:
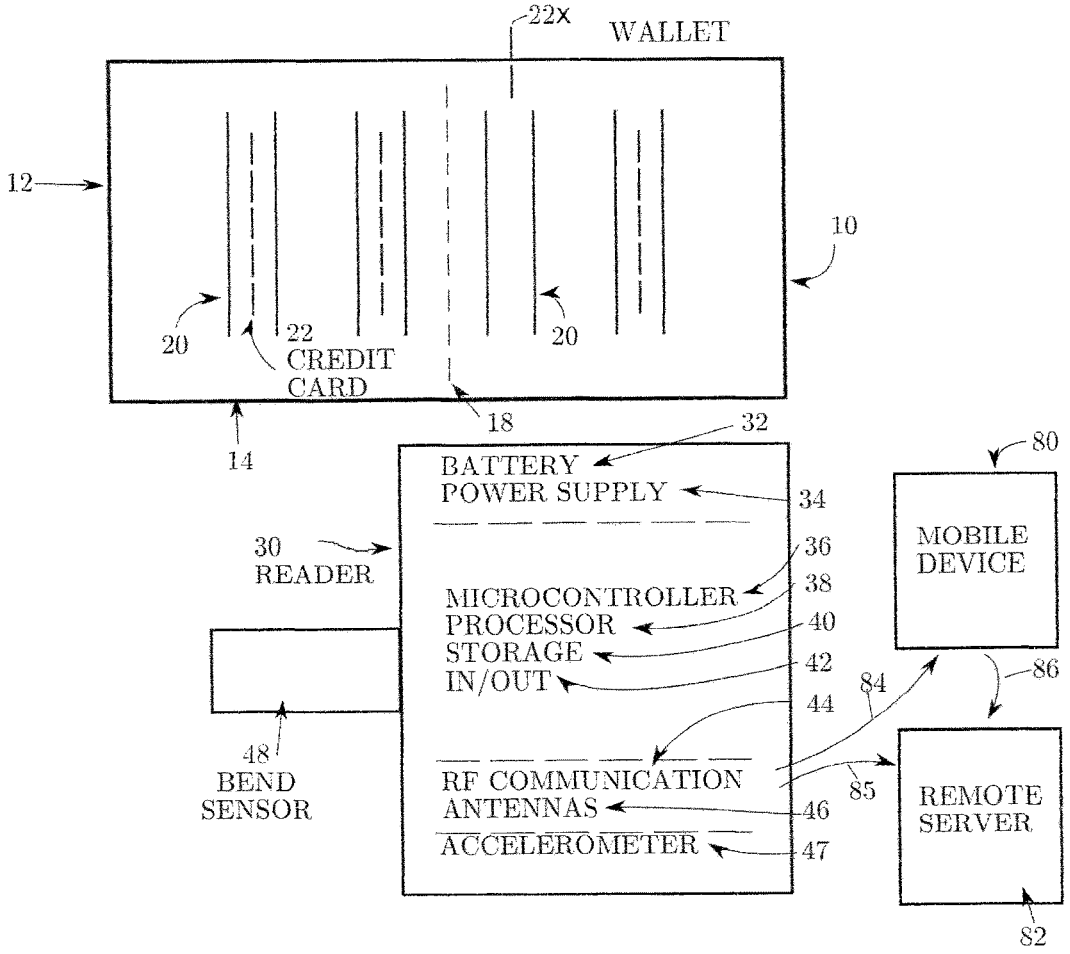
FIG. 3 is a functional block diagram similar to FIG. 1 but enhanced to show communication with a mobile device and/or a remote server.

Whereas the embodiment of FIG. 1 contemplated that the wallet mounted card reader 30 handles all data processing and storage, the embodiment of FIG. 3 depicts optional communication between the onboard card reader and a mobile device 80, and/or a remote server 82. More particularly, the RF communications transceiver 44 is configured to communicate via link 84, e.g. a Bluetooth antenna, with the user's mobile device (e.g., smart phone, smart wearable), generally carried by the user, and via link 85 to the remote server 82 (e.g., via WiFi). The mobile device 80 communicates with server 82 via link 86. As previously mentioned, the mobile device is able to execute apps enabling the user to interact with and set various parameters of the card reader's operation. Additionally, much of the data processing and storage function performed by the wallet mounted reader in FIG. 1 can be assumed by the mobile device, thereby reducing the demand on the wallet mounted battery/power supply 34 and providing better user input/output functionality offered by the keyboard display of the mobile device.

Figure 4:
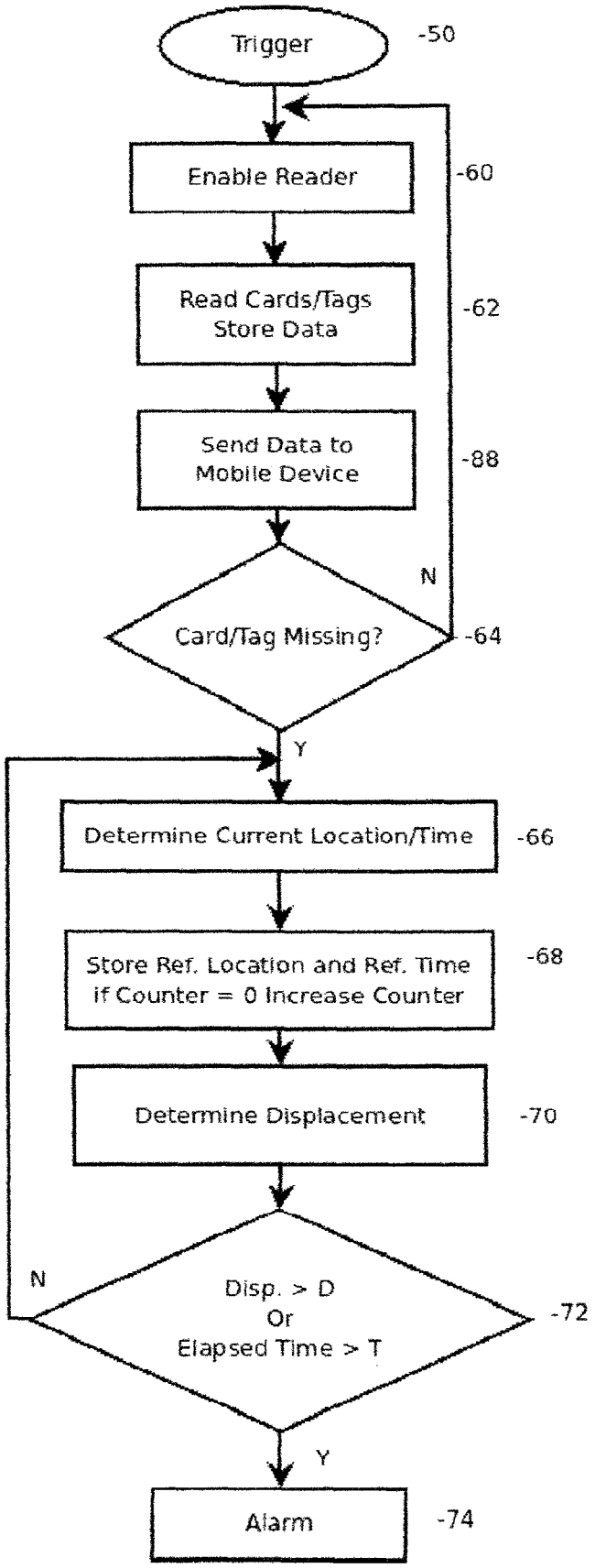
FIG. 4 is a high level flow chart depicting the operation of the embodiment of FIG. 3 when paired with a mobile device.

FIG. 4 is a flow chart describing the operation of the embodiment of FIG. 3. It should be noted that FIG. 4 is identical to FIG. 2 except for the addition of block 88 which represents the sending of card data from the wallet mounted card reader 30 to the mobile device 80. FIG. 4 contemplates that the function blocks subsequent to block 88, i.e., 64, 66, 68, 70, 72, 74 be executed by the mobile device 80.

Figure 5:
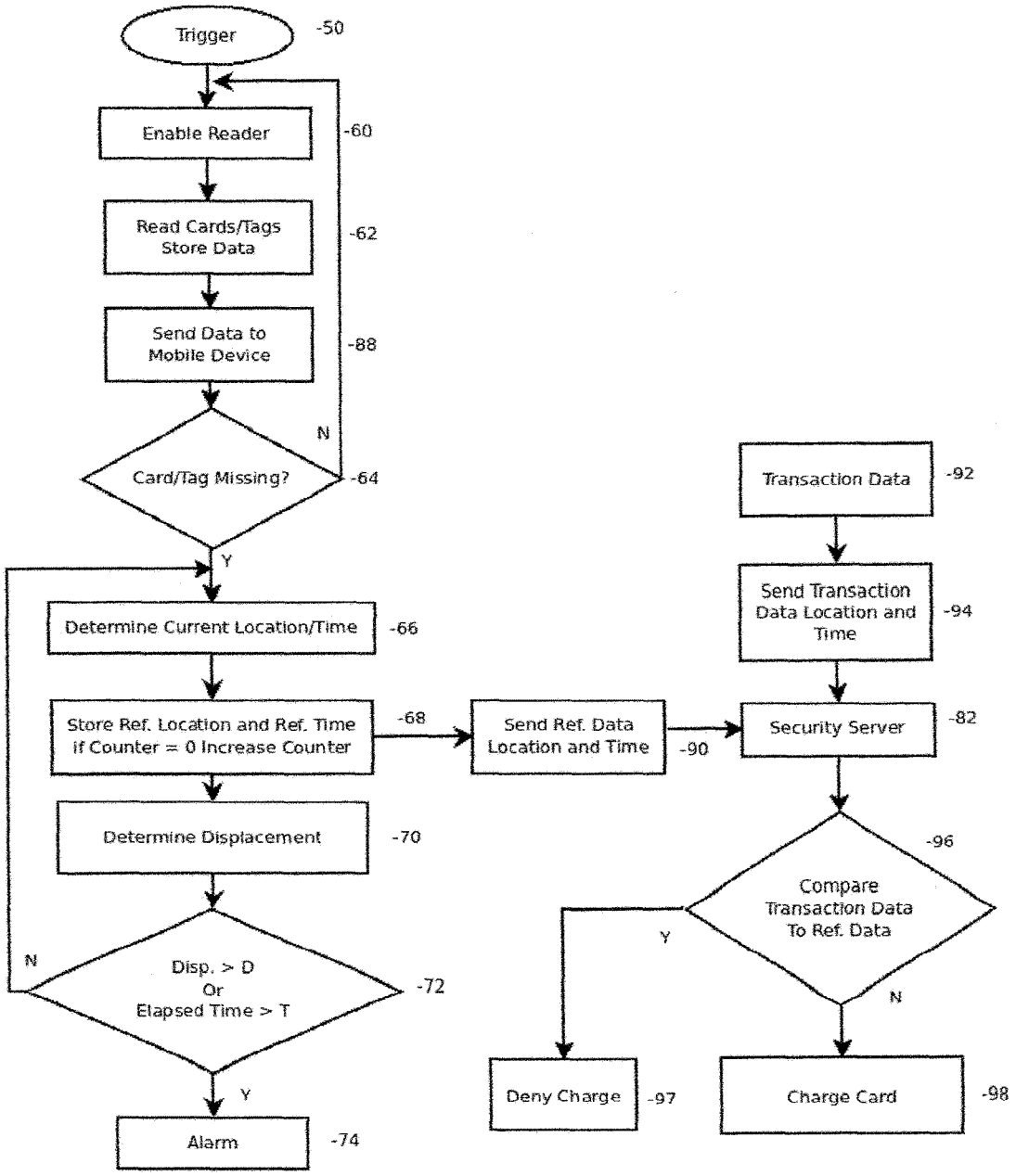
FIG. 5 is a high level flow chart depicting the operation of the embodiment of FIG. 3 for communication with a mobile device and a remote server.

It has been mentioned with reference to FIG. 3 that the card reader 30 and mobile device 80 are configured to respectively communicate with remote server 82 via links 85 and 86. These communication links can be useful in a variety of situations but particularly to reduce the fraudulent use of stolen credit cards. That is, as depicted in FIG. 5, in addition to storing the reference location and time of day information represented by block 68, this reference information is sent via block 90 to the remote security server 82 associated with a credit card company. In the normal processing of credit cards, the security server 82 receives transaction data (including location and time of day) generated in a card transaction 92 via function block 94. This enables the security server 82 to compare (block 96) the transaction data with the reference data derived from the wallet via block 90 to assist in determining whether a credit card should be honored (block 97) or denied (block 98).

The system described by FIGS. 3 and 5 can be advantageously employed in a variety of other situations to reduce fraudulent card use. Consider, for example, use by TSA to assist in airport security. When a missing card is recognized, the wallet card reader can associate identification passkey with the missing card data. The card reader directly, or via the mobile device, can then transmit this information to the TSA security server alerting TSA to the time and location that the card was removed. Then, when a person tries to use the physical card for identification, he would also need to have the wallet generated passkey for verification.

From the foregoing, it should now be understood that a system in accordance with the invention functions to protect a user's credit card from physical loss and fraudulent use. In a typical scenario, a user will load his initial set of cards into his wallet to allow the card reader to store identification data describing all of the cards in the initial card set. After this initializing procedure, whenever the wallet is opened, the card reader will be activated to read the cards and determine whether any card is missing. If a card is missing, the card reader will generate an audible alert. If the user then closes the wallet without replacing the card, another audible alert can be generated. If the user then walks away from his original location, e.g., his restaurant table, further alerts will be generated when his displacement exceeds a preset threshold value. Additionally, a signal can be sent to a remote server advising of the missing card enabling this information to be incorporated into execution of a card security algorithm. When the card is returned to the wallet, the system resets and the alert is terminated. The system can be configured to retain a record of card withdrawals so a user can, for example, view a record of his card uses during the last two weeks.

Although only a limited number of embodiments have been described herein, it is recognized that variations and modifications will occur to those skilled in the art within the intended scope of the invention as defined by the appended claims. As an example, it is recognized that some of the aforedescribed functionality can be performed by either the mobile device and/or the card reader. Moreover, additional functionality can be readily introduced. For example, the communication link between the card reader and mobile device can monitored to detect loss of the wallet relative to the mobile device.

What is claimed is:

1. A system useful in combination with a wallet configured to accommodate a set of credit cards, said system including:

a contactless reader in said wallet for detecting when a card is absent from said wallet;

a processor for determining the current physical location of said reader;

a storage device for storing reference information describing the wallet's reference location when the card was recognized as absent; and wherein said processor is operable to determine the physical displacement of said reader from said reference location to a current physical location.

2. The system of claim 1 further including:

output means for alerting a user when a card is absent from said wallet.

3. The system of claim 1 further including wireless communication means for communicating said reader with a mobile device and/or a remote server.

4. The system of claim 1 including a circuit board carrying said reader, said processor, and said communication means, said circuit board configured for removable mounting in said wallet.

5. The system of claim 1 further including a mobile device containing said processor; and wireless communication means for communicating said reader to said mobile device.

6. The system of claim 5 wherein said reference information includes data describing the time of day when the card was recognized as absent.

7. A wallet configured to accommodate a set of multiple credit cards comprising:

location determining means operable to generate location data describing the current physical location of said wallet;

a card reader mounted in said wallet operable to recognize when a credit card becomes missing from said wallet;

a processor operable to store reference data describing the physical location of said wallet when a credit card is recognized as missing;

displacement determining means operable to determine the physical displacement between the current location of said wallet and the location described by said reference data; and alert means for generating a user alert when said physical displacement exceeds a defined threshold.

8. The wallet of claim 7 wherein said card reader is configured for removable mounting in said wallet.

9. The wallet of claim 7 including first and second wallet panels configured to hinge around a fold line between a wallet closed position and a wallet open position.

10. The wallet of claim 9 wherein said card reader includes a battery power supply operable to provide power at either an active level or an inactive level; and wherein said battery power supply operates at said inactive level when said wallet is in said wallet closed position.

11. The wallet of claim 7 wherein each of said credit cards carries identification data; and wherein said card reader includes contactless interrogation means for determining whether each card in said credit card set is present.

12. The wallet of claim 11 wherein said interrogation means includes an RF transceiver.

13. The wallet of claim 7 further including RF transceiver means for wirelessly communicating with a remote device.

14. The wallet of claim 13 wherein said remote device comprises a mobile processor.

15. The wallet of claim 13 wherein remote device comprises a security function server.

16. A system for avoiding credit card loss comprising:

a wallet configured to accommodate a set of multiple credit cards;

a card reader mounted in said wallet for detecting the absence of a credit card from said set of multiple credit cards;

a storage device operable to store reference data identifying the physical location of said wallet when a credit card is detected as absent;

a displacement determining processor operable to determine the physical displacement of said wallet away from said identified by said reference data location; and a user alert responsive to said physical displacement exceeding a defined threshold.

17. The system of claim 16 including a mobile device; and wherein said mobile device includes said displacement determining processor.

18. The system of claim 17 further including wireless means for communication between said card reader and said mobile device.

19. The system of claim 16 wherein said displacement determining processor includes accelerometer means.

20. The system of claim 16 wherein said card reader is configured for removable mounting in said wallet.

21. A method of monitoring a set of multiple cards accommodated in a wallet comprising:

providing a contactless reader for recognizing when one of said cards is removed from said wallet;

mounting said reader in said wallet;

generating data describing the wallet's current physical location;

responding to the removal of a card from said wallet for storing reference data describing the wallet's fixed physical location; and determining the displacement of said wallet from said fixed physical location to the wallet's current physical location.

22. The method of claim 21 further including:

generating an alert when the displacement between the location described by said reference data and said current physical location exceeds a certain threshold.

* * * * *